US005239924A

United States Patent [19]

Wallmann et al.

[11] Patent Number: 5,239,924

[45] Date of Patent: Aug. 31, 1993

[54] PRINTING PRESS, PREFERABLY FLEXOGRAPHIC PRINTING PRESS

[75] Inventors: Wilfried Wallmann, Lengerich; Günter Rogge, Lienen, both of Fed. Rep. of Germany

[73] Assignee: Windmoeller & Holscher, Lengerich, Fed. Rep. of Germany

[21] Appl. No.: 707,010

[22] Filed: May 29, 1991

[30] Foreign Application Priority Data

May 29, 1990 [DE] Fed. Rep. of Germany ..... 4017285

[51] Int. Cl.[5] ..... B41F 13/12; B41F 33/00

[52] U.S. Cl. ..... 101/179; 101/178; 101/486; 101/DIG. 36; 101/481; 101/248; 101/254; 101/220

[58] Field of Search ..... 101/178, 486, 179, 221, 101/220, 481, 248, 254, 262, DIG. 36

[56] References Cited

U.S. PATENT DOCUMENTS

| | | | |
|---|---|---|---|
| Re. 25,134 | 3/1962 | Kinzelman | 101/178 |
| 2,278,933 | 4/1942 | Kott | 101/221 X |
| 3,915,090 | 10/1975 | Horst | 101/426 |
| 4,220,084 | 9/1980 | MacLean | 101/235 |
| 4,438,694 | 3/1984 | Parkins | 101/152 |

FOREIGN PATENT DOCUMENTS

| | | | |
|---|---|---|---|
| 972616 | 7/1949 | Fed. Rep. of Germany | 101/178 |
| 1095247 | 11/1954 | Fed. Rep. of Germany | 101/178 |
| 1056573 | 3/1955 | Fed. Rep. of Germany | 101/178 |
| 2951249 | 7/1980 | Fed. Rep. of Germany | 101/221 |
| 3239114 | 8/1983 | Fed. Rep. of Germany . | |
| 3432572 | 3/1985 | Fed. Rep. of Germany . | |
| 3437216 | 4/1986 | Fed. Rep. of Germany . | |
| 993049 | 10/1951 | France . | |
| 2550995 | 3/1985 | France . | |
| 2145663 | 4/1985 | United Kingdom | 101/178 |
| 2151188 | 7/1985 | United Kingdom | 101/178 |

*Primary Examiner*—Edgar S. Burr
*Assistant Examiner*—Eric P. Raciti
*Attorney, Agent, or Firm*—Keck, Mahin & Cate

[57] ABSTRACT

This invention relates to a printing press including an impression cylinder and a plurality of printing units which include drive gears and plate cylinders which are movable into and out of engagement with the impression cylinder. The press also includes a driven central gear which is coaxial to the impression cylinder and in mesh with all plate cylinder drive gears. The plate cylinders are permitted to have a plate length which is not exactly equal to an integral multiple of the tooth pitch of the plate cylinder gears so that the peripheral length of the plate cylinder is not an integral multiple of the tooth pitch of the central gear. The central gear is operatively connected by a gear train to drive a gear that is secured to the stub shaft of the impression cylinder. The gear train includes a differential gear train which has an input member that is adapted to be driven by an infinitely controllable transmission or by a stepping motor or the like. The input member is driven at such a modifying speed that the impression cylinder will rotate at a peripheral velocity which is equal to the peripheral velocity of the plate cylinders.

6 Claims, 2 Drawing Sheets

PRINTING PRESS, PREFERABLY FLEXOGRAPHIC PRINTING PRESS

FIELD OF THE INVENTION

This invention relates to a printing press, preferably a flexographic printing press, including an impression cylinder and a plurality of printing units having drive gears and plate cylinders, which are movable into and out of engagement with the impression cylinder, and also including a driven central gear which is coaxial to the impression cylinder and in mesh to drive all plate cylinder drive gears.

BACKGROUND

A flexographic printing machine of that kind is known, e.g., from Published German Application 34 37 216, and in that known machine the central gear is permanently fixed to the shaft of the impression cylinder so that the plate cylinders must have peripheral length which is an integral multiple of the tooth pitch of the central gear, which is used to drive the impression cylinder, and the diameter of the plate cylinders must be correspondingly selected. This is so because the plate cylinders and the impression cylinder will not rotate at the same peripheral velocity unless the diameters of the plate cylinders employed are exactly equal to an integral multiple of the tooth pitch and the pitch diameters of the plate cylinder gears and of the central gear match the diameters of the plate cylinders and of the impression cylinder, respectively, so that a relative velocity between the plate cylinder and the impression cylinder will be avoided and there will be no slippage or smearing of the web to be printed. But it is often necessary to print on a format having a length which requires the use of plate cylinders having a diameter which is not exactly equal to an integral multiple of the tooth pitch. In the performance of such printing jobs a certain slippage of the web to be printed on the impression cylinder and possibly also smeared print was inevitable.

It is known from Published German Application 32 39 114 that the peripheral velocity of a plate cylinder which is movable into engagement with an impression cylinder can be matched to the peripheral velocity of the impression cylinder without an occurrence of relative movements between said two cylinders. The peripheral velocities are measured and depending upon any differential peripheral velocity, velocity control means matches the peripheral velocities of the two cylinders such that relative peripheral velocity between the two rollers will be eliminated. By means of such velocity control means it is possible in a printing press to avoid, e.g., an occurrence of a relative peripheral velocity which may be the result of a thermal expansion of the cylinders.

In order to avoid an occurrence of relative movements which may occur between an impression cylinder and a plate cylinder as a result of tooth pitch difference it is known from Published German Application 34 32 572 that the impression cylinder and the associated inking roller can be driven by exactly controllable drive motors. In that press the plate cylinder and the inking roller are not operatively interconnected by gearing. But such printing press is relatively expensive because it does not have a central drive but all cylinders and rollers must be driven by separate drive motors, which must exactly be controlled.

SUMMARY OF THE INVENTION

It is an object of the invention to provide a printing press of the kind described which permits the use of plate cylinders having a plate length which is not exactly equal to an integral multiple of the tooth pitch so that the peripheral length of the plate cylinder is not an integral multiple of the tooth pitch of the central gear.

In a printing press, of the kind described that object is accomplished, in accordance with the invention, in that the central gear is freely-rotatively mounted on a stub shaft of the impression cylinder, or on a pin that is axially aligned therewith, and the impression cylinder is operatively connected to a controllable drive for driving the impression cylinder at a peripheral velocity which is substantially equal to the measured peripheral velocity of the plate cylinders. In the printing press in accordance with the invention the plate cylinders are not permanently coupled to the impression cylinder by plate cylinder gears in mesh with a central gear that is permanently connected to the impression cylinder. The central gear serves only to drive all plate cylinders in phase synchronism to rotate at the same peripheral velocity. The impression cylinder is not coupled to the central gear but is operatively connected to a separate drive for driving said impression cylinder, regardless of the tooth pitch, at a peripheral velocity which equals the velocity of the web and equals the peripheral velocity of the plate cylinders.

According to a desirable feature of the invention, the central gear is operatively connected by a gear train to a drive gear that is secured to the stub shaft of the impression cylinder. The gear train includes a differential gear train which has an input member that is adapted to be driven by an infinitely controllable transmission, a stepping motor or the like. The input member is rotated at such a modifying speed that, the drive gear will rotate the impression cylinder at a peripheral velocity which is equal to the peripheral velocity of the plate cylinders. The basic drive of the impression cylinder is also derived from the main drive of the printing press and the differential gear train is used to introduce such a positive or negative modifying speed that the impression cylinder will rotate at a peripheral velocity which equals the velocity of the web which is to be printed.

For the control of the infinitely controllable transmission (consisting, e.g., of proportional-plus-integral transmission) or the stepping motor or the like means, the velocity of the printed web is measured and signals are generated which are proportional to the measured velocity and are used by a controller for the generation of the required control signals.

For the measurement of the web velocity and for the generation of signals which are proportional to the measured velocity, it is possible to detect printed marks by means of optic sensors or to use a sensor to count processing cycles to which the web has subsequently been subjected in equal length portions. For instance, the printed web may be divided in an ensuing processing station into sections corresponding to the sheet length. Then the number of processing cycles per unit of time may be counted and may be arithmetically converted to signals which are proportional to velocity.

If the printing press includes pinch rollers and/or if the printing press is operatively connected to further processing means, such pinch rollers and/or further processing means may also be driven by controllable drives in dependence on the measured web velocity.

DETAILED DESCRIPTION OF THE PREFERRED EMBODIMENTS

Figure 1:
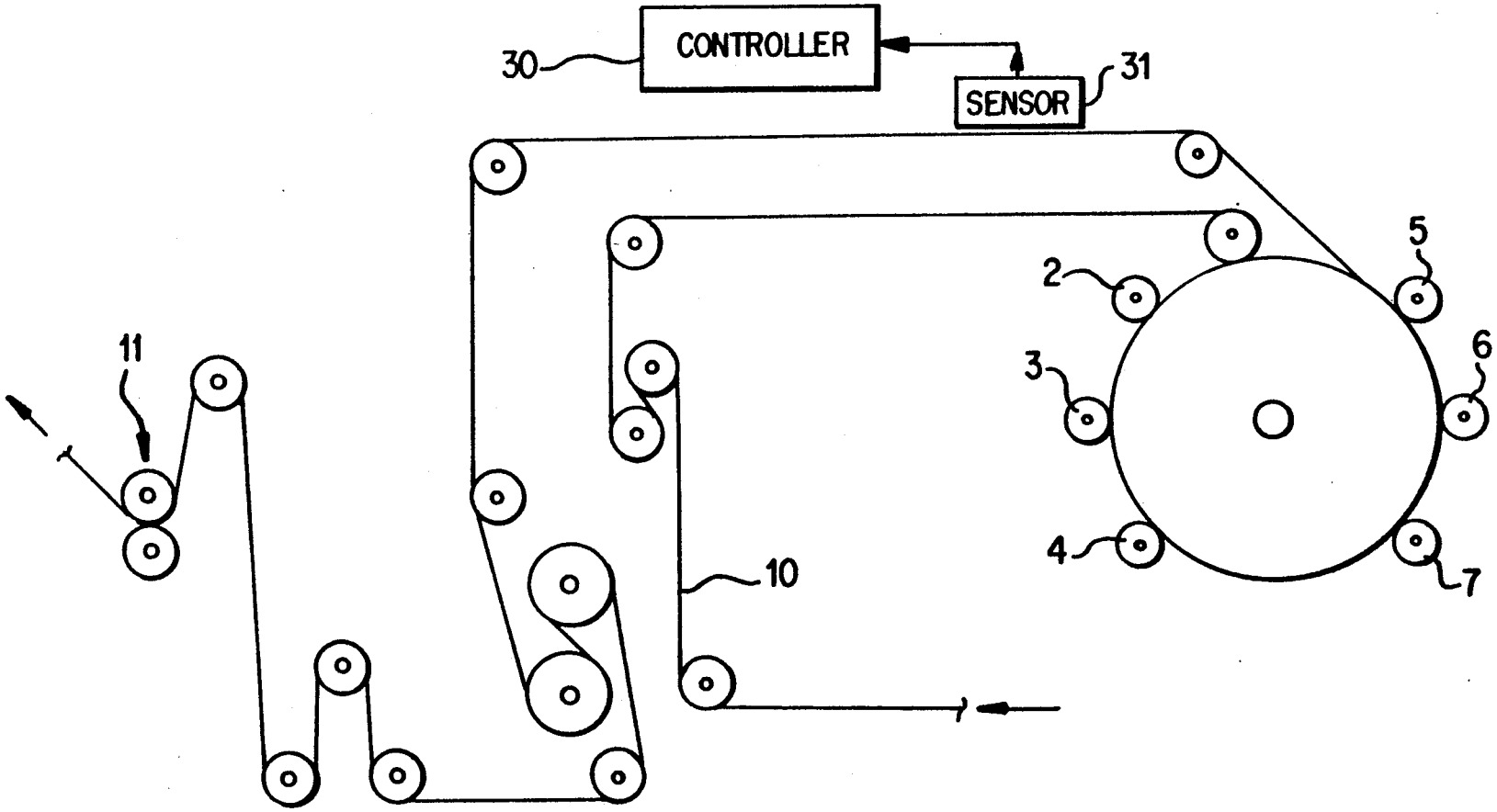
FIG. 1 is a diagrammatic side elevation showing a flexographic printing press comprising six inking mechanisms, with guide rollers, and showing pinch rollers and further processing means.

An illustrative embodiment of the invention will now be explained in more detail with reference to the drawing.

FIG. 1 is a diagrammatic representation of a flexographic printing press which comprises an impression cylinder and six printing units, which for the sake of simplicity are represented in FIG. 1 only by their plate cylinders 2 to 7. The flexographic printing press is of a basically known design, such as has been disclosed in Published German Application 34 37 216, and for this reason is not described herein in more detail. The web 10 to be printed moves in the illustrated manner in contact with guiding and pinch rollers and then through a diagrammatically indicated, processing station 11, in which e.g., the printed web is provided, with punched marks which are spaced apart by the length of the printed sheets.

Figure 2:
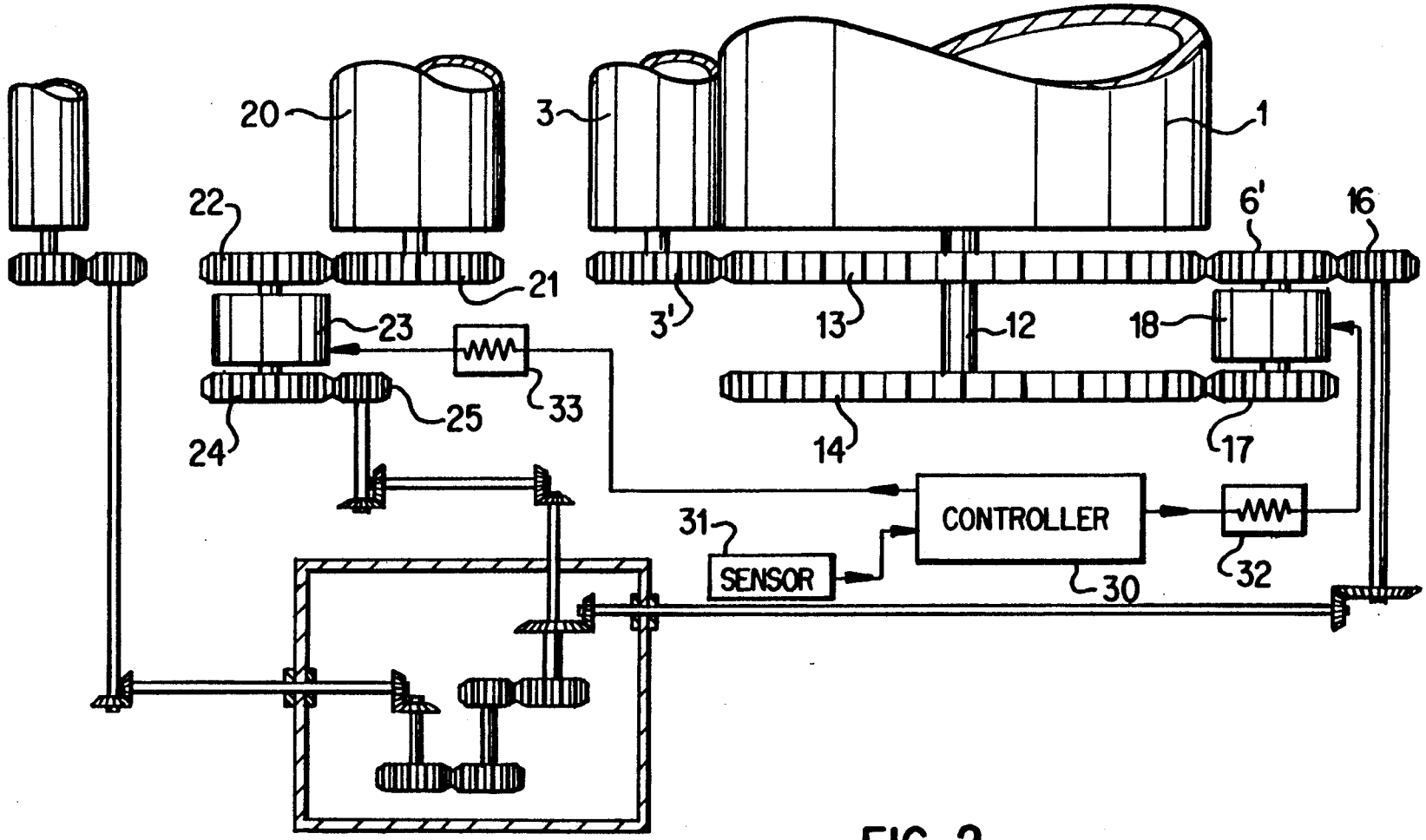
FIG. 2 is a diagrammatic representation of the drives for the impression cylinder, the plate cylinders, the pinch rollers and the ensuing processing means.

FIG. 2 is a diagrammatic representation showing impression cylinder 1 and plate cylinder 3. Central gear 13 is freely rotatably mounted on the stub shaft 12 of the impression cylinder 1. The drive gear 14 for the impression cylinder 1 is firmly keyed to the stub shaft of the impression cylinder 1. The freely rotatable central gear 13 is in mesh with all plate cylinder gears which are provided on the plate cylinders 2 to 7 and of which only the gears 3' and 6' are shown. The central gear 13 and the plate cylinder gears are driven via a driving pinion 16 by the main drive of the printing press. The impression cylinder gear 14 is driven via the gear 17 which is secured to the output shaft of the differential gear train 18. One input member of the differential gear train 18 is nonrotatably connected to the plate cylinder gear 6'. By means of a drive 32 comprising an infinitely controllable transmission (proportional-plus-integrating transmission) or a stepping motor or the like, a second input member of the differential gear train 18 is driven in a positive or negative sense at such a modifying speed that the impression cylinder 1 rotates at a peripheral velocity which is equal to the velocity of the plate cylinders 2 to 7. That modifying speed is determined by control means 30 in dependence on measurements of the web velocity or on the peripheral velocity of at least one plate cylinders by sensor means 31. If the plate cylinder gears have the same tooth pitch as the central gear and the drive gear for the impression cylinder, it will not be necessary in the most favorable case to effect a velocity compensation by means of the differential gear train 18. The gearing connected to pinch rollers and to succeeding processing stations is diagrammatically indicated in FIG. 2 by angle drives, drive shafts and transmission stages.

The cylinder 20 may represent, e.g., a roller of a pair of pinch rollers or a roller of a processing station and is driven by the roller gear 21. The roller gear 21 is in mesh with the gear 22, which is keyed to the output shaft of a differential gear train 23. The gear 24 is fixed to one input shaft of the differential gear train 23 and is driven by the pinion 25, which is operatively connected as shown by angle drives and transmission stages to the main drive.

A second input shaft of the differential gear train 23 is adapted to be driven at a modifying speed in the manner which has been explained for the differential gear train 18 by another drive 33 of like form to drive 32.

We claim:

1. A printing press, preferably a flexographic printing press, for printing on a moving web and comprising:
   a) an impression cylinder rigidly mounted on a stub shaft;
   b) a plurality of printing units which include drive gears and plate cylinder which are movable into and out of engagement with the impression cylinder;
   c) driven central gear means which is freely-rotatively mounted on the stub shaft of the impression cylinder and in mesh with all plate cylinder drive gears for driving the plate cylinders at a predetermined peripheral velocity; and
   d) controllable drive means for driving the impression cylinder to rotate at a peripheral velocity which is equal to a measured velocity of the web and which is also equal to the peripheral velocity of the plate cylinders.

2. A printing press according to claim 1, further comprising:
   a) an impression gear that is secured to the stub shaft of the impression cylinder; and
   b) a gear train driven by the central gear and operatively connected to drive the impression gear and which includes a differential gear train which has an input member that is adapted to be driven by drive means for driving such input member at such a modifying speed that the impression cylinder will rotate at a peripheral velocity which is equal to the peripheral velocity of the plate cylinders.

3. A printing press according to claim 2, further comprising:
   a) sensor means to measure the velocity of the web for the generation of signals proportional to the measured velocity; and
   b) a controller which receives such velocity signals for the generation of the required control signals for controlling the infinitely controllable transmission or stepping motor or the like.

4. A printing press according to claim 3, in which such sensor means includes,
   means to detect printed marks or means to count processing cycles to which the web has subsequently been subjected in equal length portions.

5. A printing press according to claim 4, further comprising:
   one or more pinch rollers; and in which,
   one or more of such pinch rollers are provided with drives and means for controlling the drives in dependence on the measured web velocity.

6. A printing press according to claim 1, further comprising:
   one or more pinch rollers; and in which,
   one or more of such pinch rollers are provided with drives and means for controlling the drives in dependence on the measured web velocity.

* * * * *